US007841402B2

(12) United States Patent
Georgi et al.

(10) Patent No.: US 7,841,402 B2
(45) Date of Patent: Nov. 30, 2010

(54) METHODS AND APPARATUS FOR COLLECTING A DOWNHOLE SAMPLE

(75) Inventors: Daniel T. Georgi, Houston, TX (US); Aleksandr A. Kashevarov, Novosibirsk (RU); Artem V. Manakov, Novosibirsk (RU)

(73) Assignee: Baker Hughes Incorporated, Houston, TX (US)

( * ) Notice: Subject to any disclaimer, the term of this patent is extended or adjusted under 35 U.S.C. 154(b) by 57 days.

(21) Appl. No.: 12/099,984

(22) Filed: Apr. 9, 2008

(65) Prior Publication Data

US 2009/0255671 A1 Oct. 15, 2009

(51) Int. Cl.
*E21B 49/08* (2006.01)

(52) U.S. Cl. ..... 166/250.12; 166/100; 73/152.55

(58) Field of Classification Search ..... 166/264, 166/250.12, 381, 186, 100; 73/152.23, 152.26, 73/152.55

See application file for complete search history.

(56) References Cited

U.S. PATENT DOCUMENTS 2,728,395 A 12/1955 Howard
3,107,730 A * 10/1963 Lebourg ..... 166/100
4,635,717 A 1/1987 Jageler
5,097,914 A 3/1992 Grotendorst
5,303,775 A 4/1994 Michaels et al.
5,617,927 A 4/1997 Maissa
5,687,791 A 11/1997 Beck et al.
5,741,962 A 4/1998 Birchak et al.
6,157,893 A * 12/2000 Berger et al. ..... 702/9
6,301,959 B1 10/2001 Hrametz et al.
6,446,719 B2 * 9/2002 Ringgenberg et al. .. 166/250.12
6,722,432 B2 4/2004 Spiers et al.
7,021,406 B2 4/2006 Zitha
7,121,338 B2 10/2006 van Zuilekom et al.
7,263,881 B2 9/2007 Ramakrishnan
7,469,746 B2 * 12/2008 Tarvin et al. ..... 166/264
7,484,563 B2 * 2/2009 Zazovsky et al. ..... 166/264
2004/0201174 A1 10/2004 Dodgson et al.
2006/0076132 A1 4/2006 Nold et al.
2006/0128881 A1 6/2006 George et al.
2007/0045005 A1 3/2007 Tchakarov et al.
2007/0227733 A1 10/2007 Vercaemer et al.
2008/0066534 A1 3/2008 Reid et al.

OTHER PUBLICATIONS

International Search Report of International Application PCT/US2009/040015. Mailed Sep. 24, 2009.
Written Opinion of the International Searching Authority for International Application No. PCT/US2009/040015. Mailed Sep. 24, 2009.

* cited by examiner

*Primary Examiner*—Daniel P Stephenson
(74) *Attorney, Agent, or Firm*—Cantor Colburn LLP

(57) ABSTRACT

Apparatus and methods for collecting a downhole sample are provided. The method may include introducing a flowable sealant to a borehole wall portion, modifying a formation system mobility using the flowable sealant, and receiving the downhole sample using a sample receiving port positioned proximate the borehole wall portion. An apparatus includes a formation sampling member having a sample receiving port for receiving the downhole sample, and an inhibitor that includes one or more of an activator and an injector.

23 Claims, 5 Drawing Sheets

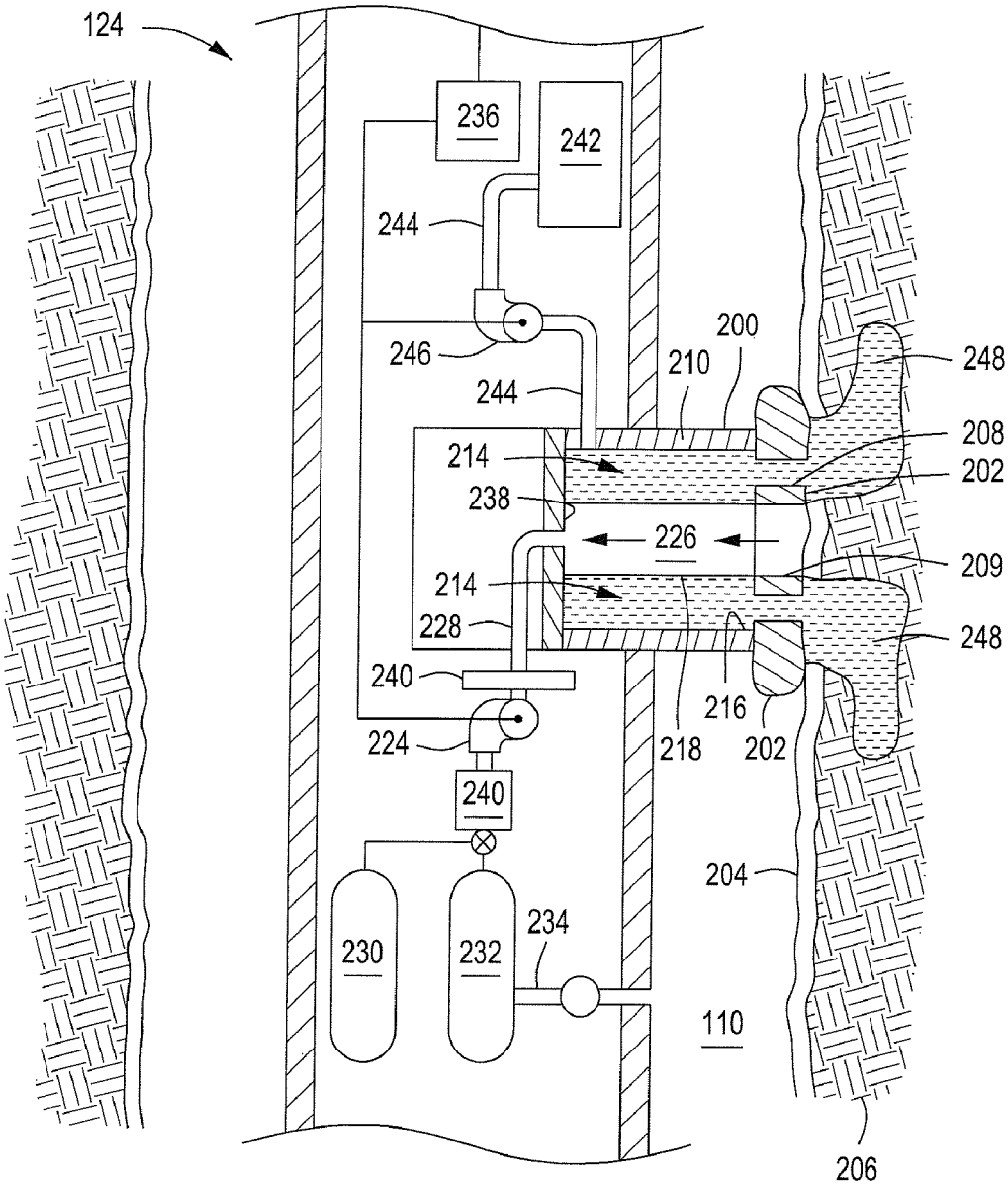
FIG. 2
FIG. 3
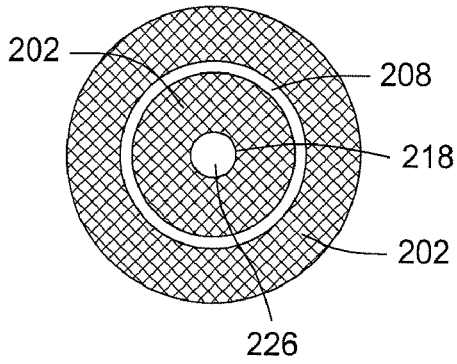

METHODS AND APPARATUS FOR COLLECTING A DOWNHOLE SAMPLE

CROSS-REFERENCE TO RELATED APPLICATIONS

Not Applicable

BACKGROUND

1. Technical Field

The present disclosure generally relates to well bore tools and in particular to apparatus and methods for collecting downhole samples.

2. Background Information

Oil and gas wells have been drilled at depths ranging from a few thousand feet to as deep as 5 miles. Wireline and drilling tools often incorporate various sensors, instruments and control devices in order to carry out any number of downhole operations. These operations may include formation testing and monitoring and tool monitoring and control.

Formation testing tools have been used for monitoring formation pressures along well boreholes, obtaining formation fluid samples, and predicting performance of reservoirs. Such formation testing tools typically contain an elongated body having an elastomeric packer and/or pad that is sealingly pressed against a zone of interest in the borehole to collect formation fluid samples in fluid receiving chambers placed in the tool. The borehole can be sealed off, either completely or partially, from the formation with a mud cake formed by the drilling fluid. The formation testing tool can be sealingly pressed against the borehole wall with the mud cake providing a seal between the formation testing tool and the borehole wall.

Formation testing tools have been developed with extendable sampling probes for engaging the borehole wall at the formation of interest for withdrawing fluid samples from the formation and for measuring pressure. In formation testing tools of this nature an internal pump or piston may be used after engaging the borehole wall to reduce pressure at the formation tool interface causing fluid to flow from the formation into the formation tool. The seal between the mud cake and the elastomeric packer and/or pad/probe can be poor, which can lead to drilling fluid leaking into the formation and/or the downhole sample as it is acquired. There is a need, therefore, for improved apparatus and methods for reducing the potential for drilling fluid and other impurities from contaminating downhole samples.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

Disclosed is a method for collecting a downhole sample that includes introducing a flowable sealant to a borehole wall portion, modifying a formation system mobility using the flowable sealant, and receiving the downhole sample using a sample receiving port positioned proximate the borehole wall portion.

Another method disclosed for collecting a downhole sample includes contacting a borehole wall portion using a sampling tool that includes a sample receiving port for receiving the downhole sample, the sample receiving port is in fluid communication with a fluid cell, introducing a flowable sealant to a borehole wall portion proximate the sample receiving port, and flowing the downhole sample through the sample receiving port to the fluid cell.

Another aspect disclosed is an apparatus for collecting a downhole sample that includes a formation sampling member having a sample receiving port for receiving the downhole sample, and an inhibitor that includes one or more of an activator and an injector.

BRIEF DESCRIPTION OF THE DRAWINGS

For a detailed understanding of the present disclosure, reference should be made to the following detailed description of the several non-limiting embodiments, taken in conjunction with the accompanying drawings, in which like elements have been given like numerals and wherein:

FIG. 2 is an elevation view that illustrates a non-limiting example of a downhole tool according to the disclosure;

FIG. 3 is an illustrative frontal view of a non-limiting extendable co-axial formation fluid sampling probe according to the disclosure;

DESCRIPTION OF EXEMPLARY EMBODIMENTS

Figure 1:
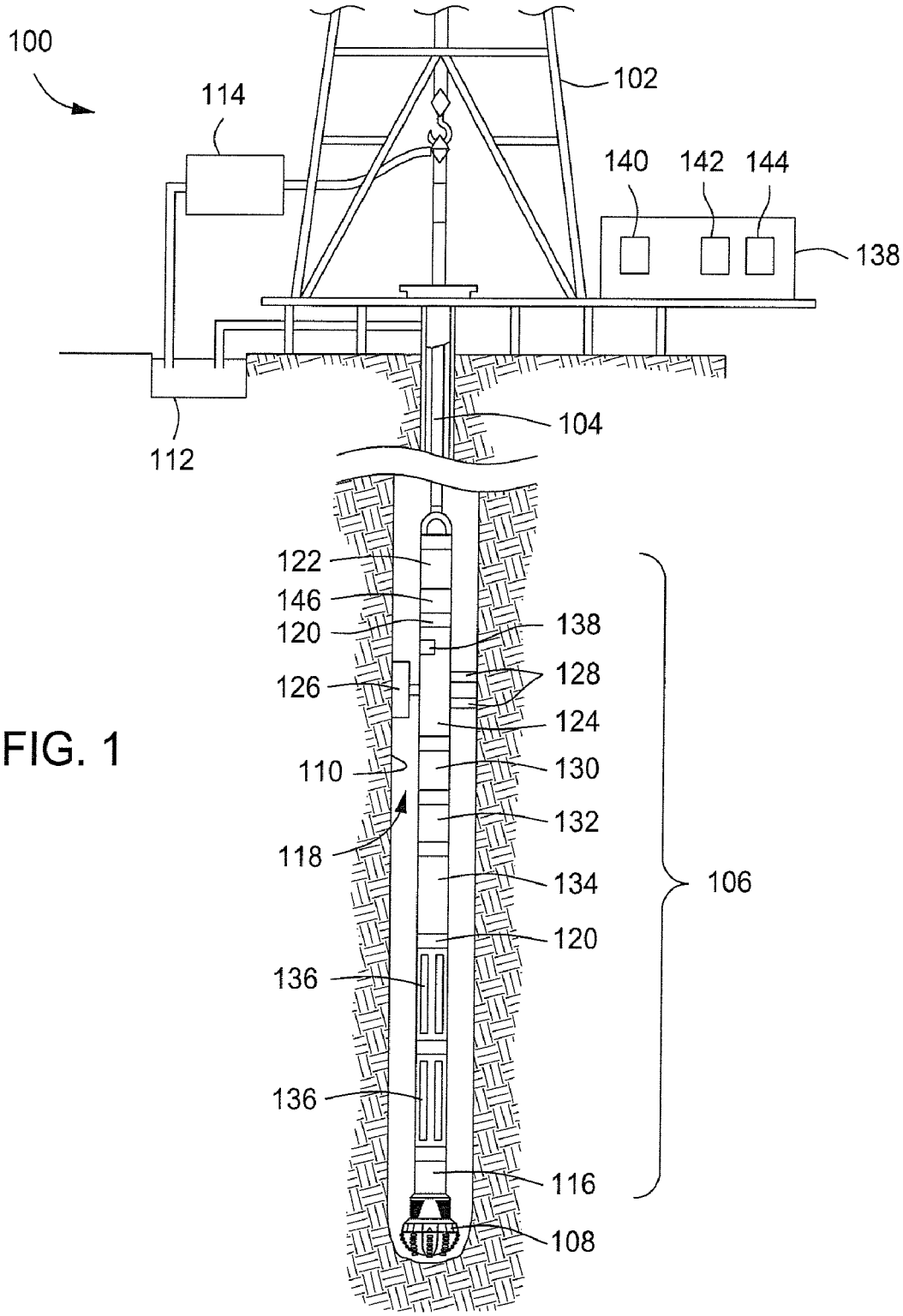
FIG. 1 is an exemplary wireline system according to several embodiments of the disclosure.

FIG. 1 schematically illustrates a non-limiting example of a drilling system 100 in a measurement-while-drilling ("MWD") arrangement according to several non-limiting embodiments of the disclosure. A derrick 102 supports a drill string 104, which may be a coiled tube or drill pipe. The drill string 104 may carry a bottom hole assembly ("BHA") referred to as a downhole sub 106 and a drill bit 108 at a distal end of the drill string 104 for drilling a borehole 110 through earth formations.

The exemplary drill string 104 operates as a carrier, but any carrier is considered within the scope of the disclosure. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, downhole subs, BHA's, drill string inserts, modules, internal housings and substrate portions thereof.

Drilling operations according to several embodiments may include pumping drilling fluid or "mud" from a mud pit 112, and using a circulation system 114, circulating the mud through an inner bore of the drill string 104. The mud exits the drill string 104 at the drill bit 108 and returns to the surface through an annular space between the drill string 104 and inner wall of the borehole 110. The drilling fluid is designed to provide a hydrostatic pressure that is greater than the formation pressure to avoid blowouts. The pressurized drilling fluid may further be used to drive a drilling motor 116 and may be used to provide lubrication to various elements of the drill string 104.

The return fluid includes solids and liquids. The high pressure of the return fluid column forces liquids into the formation and the solids tend to accumulate along the borehole wall forming the mud cake. The fluids entering the formation are known as filtrates and the mud cake operates as a barrier between the borehole 110 and the formation. Once formed, the barrier provided by the mud cake can reduce or prevent additional mud filtrate, and other contaminants present in the borehole wall from leaking off into the formation. In many cases, however, it is still possible for drilling fluid, mud filtrate, and other contaminants present in the borehole 110 to leak through the mud cake and into the formation even after the mud cake is formed, thereby contaminating the formation and formation samples. In some cases the mud cake is damaged and in some cases the mobility or permeability of the mud cake remains too high to adequately prevent invasion of the formation.

The formation system may include, but is not limited to, fluids, solids, mud cake, the borehole wall, the formation, and any other naturally occurring or foreign introduced substance and/or structure. Formation system mobility may be discussed and described in terms of the permeability of the formation system and the viscosity of the fluids present in the formation system. As used herein, "formation system mobility" refers to the ability of fluids present in the downhole environment to flow through a structure, for example the borehole wall, mud cake, and the formation. Formation system mobility is directly related to the permeability of the formation system and the viscosity of fluids downhole. Formation system mobility may be estimated by the equation:

$$M = \frac{k}{\mu}$$

where M represents the formation system mobility, k represents the permeability f the formation system, and μ represents the viscosity of the fluids.

As used herein, the terms "formation system mobility" and "permeability" may be used interchangeably. The formation system mobility may be modified, either permanently or temporarily, by modifying the viscosity of the fluids and/or the permeability of the formation system.

In the non-limiting embodiment of FIG. 1, the downhole sub 106 includes a formation evaluation tool 118. The formation evaluation tool 118 may include an assembly of several tool segments that are joined end-to-end by threaded sleeves or mutual compression unions 120. An assembly of tool segments suitable for the present disclosure may include a power unit 122 that may include one or more of a hydraulic power unit, an electrical power unit and an electro-mechanical power unit. In the example shown, a formation sample tool 124 may be coupled to the formation evaluation tool 118 below the power unit 122.

The exemplary formation sample tool 124 shown comprises an extendable probe 126 that may be opposed by bore wall feet 128. The extendable probe 126, the opposing feet 128, or both may be hydraulically and/or electro-mechanically extendable to firmly engage the well borehole wall. The formation sample tool 124 may be configured for extracting a formation core sample, a formation fluid sample, formation images, nuclear information, electromagnetic information, and/or downhole information, such as pressure, temperature, location, movement, and other information. In several non-limiting embodiments, other formation sample tools not shown may be included in addition to the formation sample tool 124 without departing from the scope of the disclosure.

Continuing now with FIG. 1, several non-limiting embodiments may be configured with the formation sample tool 124 operable as a downhole fluid sampling tool. In these embodiments, a large displacement volume motor/pump unit 130 may be provided below the formation sample tool 124 for line purging. A similar motor/pump unit 132 having a smaller displacement volume may be included in the tool in a suitable location, such as below the large volume pump, for quantitatively monitoring fluid received by the downhole evaluation tool 118 via the formation sample tool 124. As noted above, the formation sample tool 124 may be configured for any number of formation sampling operations. Construction and operational details of a suitable non-limiting fluid sample tool 124 for extracting fluids are more described by U.S. Pat. No. 5,303,775, the specification of which is incorporated herein by reference. Suitable coring tools for use as a formation sample tool 124 may be substantially as described in U.S. Pat. No. 5,617,927 for "Sidewall Rotary Coring Tool" and in published U.S. patent application Ser. No. 11/215,271 having the publication number US 2007/0045005 A2 for "Rotary Coring Device and Method for Acquiring a Sidewall Core From an Earth Formation," which patent and published application are assigned to the assignee of the present application, and which patent and published application are hereby incorporated herein by reference.

In several embodiments to be described in further detail below, the formation sample tool 124 may include a sealant injector 138. The term "injector" as used herein includes any mechanism, device, member, or combinations thereof suitable for introducing a flowable sealant. Non-limiting examples of injectors include surface fluid circulating systems, downhole pumps, pistons, pressurized and non-pressurized containers, probes, snorkels, and tool ports. The sealant injector 138 may inject or otherwise introduce one or more flowable sealants into the borehole wall 110 and/or the formation surrounding the borehole wall 110. As used herein, the terms "flowable sealant" and "sealant" mean any substance introduced to the borehole wall, the mud cake, the formation, or a combination thereof that may be used to modify the formation system mobility.

The downhole evaluation tool 118 may include a downhole evaluation system 134 for evaluating several aspects of the downhole sub 106, the drilling system 100, aspects of the downhole fluid in and/or around the downhole sub 106, formation samples received by the downhole sub 106, and of the surrounding formation.

One or more formation sample containers 136 may be included for retaining formation samples received by the downhole sub 106. In several examples, the formation sample containers 136 may be individually or collectively detachable from the downhole evaluation tool 118.

A downhole transceiver 146 may be coupled to the downhole sub 106 for bidirectional communication with a surface transceiver 140. The surface transceiver 140 communicates received information to a controller 138 that includes a memory 142 for storing information and a processor 144 for processing the information. The memory 142 may also have stored thereon programmed instructions that when executed by the processor 144 carry out one or more operations and methods that will become apparent in view of the discussion to follow. The memory 142 and processor 144 may be located downhole on the downhole sub 106 in several non-limiting embodiments.

Referring now to FIGS. 1 and 2, one non-limiting example of a formation sample tool 124 may include a fluid sampling probe 200 having a durable rubber pad 202 at a distal end of a probe body 210. The pad 202 may be mechanically pressed against the borehole wall 204 adjacent a formation 206 so that the pad 202 contacts the borehole wall 204. The pad 202 may be pressed against the borehole wall 204 with enough force to form a seal between the borehole wall 204 and probe 200. The mud cake, which may be present along the borehole wall 204, can contribute to the seal quality formed between the pad 202 and the borehole wall 204. The pad 202 need not be rubber and may be constructed of any suitable material for forming a seal. In some cases, the pad 202 may be eliminated and the probe end may form a seal with the borehole wall 204.

In several non-limiting embodiments the pad 202 may include one or more openings or sample receiving ports 209 leading to a cavity or volume 214. The cavity 214 may be formed by an inner wall 216 of the probe body 210. In several non-limiting embodiments the fluid sampling probe 200 may include a sleeve-like member, or simply sleeve 218 disposed within the chamber 214. In one example the sleeve 218 may be a solid cylinder-shaped sleeve that extends from a rear section 238 of the probe 200 to its pad 202. The sleeve 218 may be in fluid communication with the sample receiving port 209 at the distal end of the sleeve 218. The sample receiving port 209 may be in contact with or in close proximity to the formation 206 adjacent the borehole wall 204. The sleeve 218 may provide fluid communication via a flow path 226 from the formation 206 adjacent the borehole wall 204 to a flow line 228 in fluid communication with the rear section 238.

In several non limiting embodiments, the downhole formation sample tool 124 may include an inhibitor that may include an injector, an activator or a combination thereof. As used herein, the term "inhibitor" includes any mechanism, system, device, or combinations thereof suitable for use in modifying formation system mobility by introducing a flowable sealant, activating a flowable sealant, or both before, upon, or after introduction of the flowable sealant. The inhibitor in the example shown in FIG. 2 includes a sealant reservoir or tank 242, a pump 268 and a conduit 244 for introducing the flowable sealant to the borehole wall. In another embodiment the sealant may be stored at the surface and transported through the drill string to the formation sample tool 124 though a line or tube, not shown. In another embodiment, the inhibitor may include a portion of the mud circulating system and surface equipment such as a mud pump and mud pit. The sealant reservoir 242 or a line from the surface may be in fluid communication with the cavity 214 via a flow line 244 and a pump 246. The pump 246 may supply, inject, or otherwise introduce a sealant 248 into the cavity 214 and/or an area proximate the sample receiving port 209.

In a non-limiting embodiment the sealant 248 may flow through the one or more openings 208 in the pad 202 and may be distributed or otherwise introduced about an area proximate the pad 202. The sealant may be injected through the mud cake and flow into the formation, and the sealant 248 may provide a second seal that may overlap the seal formed between the pad 202 and the borehole wall 204. The sealant 248 can improve the seal between the borehole wall 204 and the pad 202. The sealant 248 may provide a region proximate the pad 202 and within the formation with a reduced or lower permeability to prevent filtrates and/or drilling fluids from entering the formation and the tool. The region proximate the pad 202 with reduced permeability may have a lower permeability than provided by the seal between the pad 202 and the borehole wall 204 only.

The sealant 248 can provide an added barrier to prevent drilling fluid, mud filtrate, and other contaminants from leaking into the formation. The sealant 248 may be introduced to an area or volume of the formation sufficient to prevent unwanted and undesirable contaminants from leaking into the formation where a formation sample may be obtained. Although not shown, the sealant 248 may be introduced to an area of the borehole wall 204 that may include the entire region proximate the sample receiving port 209. In at least one non-limiting embodiment the sealant 248 may be introduced through the sample receiving port in addition to or rather than introducing the sealant 248 through the one or more openings 208 in the pad 202. The sealant reservoir 242 may be in fluid communication with the sample receiving port 209 via line 244 and sleeve 218. In at least one non-limiting embodiment the sealant 248 may be introduced by what is commonly referred to as spotting a pill. A pill, for example a tank, bag, or can of sealant can be introduced to the borehole 110 using the mud circulating system as an injector. The pill can release the sealant about the borehole 110 such that the sealant coats the borehole wall 204 and/or enter into the formation 206. The sealant can be evenly or unevenly distributed about a length or section of the borehole 110. The sealant can be introduced through the drill string 104, dropped or dispersed directly into the borehole, the mud circulating system, and/or the downhole formation sample tool. The sealant 248 can prevent or otherwise reduce the tendency for drilling fluid and other contaminants from leaking into the formation 206 in a region where a fluid sample may be acquired. The sealant 248 may permeate the mud cake and improve the barrier provided by the mud cake thereby reducing or eliminating the potential for drilling fluid, mud filtrate, and other contaminants from leaking into the formation 206.

In at least one embodiment the region proximate the sleeve 218 and/or pad 202 can have an area or region of lower or reduced formation system mobility due to the sealant. The sealant can be more viscous than the formation fluids or drilling fluids and/or the sealant can modify or alter the structure of the formation, mud cake, and/or borehole wall, either temporarily or permanently, to reduce the formation system mobility. This region of lower permeability may reduce or prevent fluids present in the borehole 110 from flowing into the formation 206. A flow of fluid from the formation may be directed to the area in front of the sleeve 218. A flow of fluid toward the sleeve 218 may provide a higher quality sample, that is, a less contaminated sample, than can be recovered without the sealant 248. The sealant 248 may act as a barrier or shield that may reduce or prevent foreign substances, such as, borehole fluid and mud cake from contaminating a fluid sample acquired from the formation 206 via the sample receiving port 209.

In several one non-limiting embodiments the sealant 248 may be any suitable medium or substance that can reduce the permeability of the seal formed between the pad 202 and the borehole wall 204. In at least one non-limiting embodiment, the viscosity of the sealant 248 can be sufficient enough to provide a low permeability or impenetrable region proximate the sample receiving port 209 in fluid communication with the borehole wall 204 and/or the formation 206. In another non-limiting embodiment the sealant may chemically react with the borehole wall 204 and/or the formation 206 to reduce the permeability or formation system mobility. For example, the sealant can be an acid or a base that when in contact with a particular type of formation 206 may react with the formation 206 in such a manner as to result in a reduced or non-permeable formation 206. In several non-limiting embodiments the formation system mobility may be reduced about the entire length of the borehole 110, predetermined segments or sections of the borehole 110, for example a 30 m section, or localized areas or regions, such as proximate the sample receiving port 209.

In at least one non-limiting embodiment the sealant may be or include a substance that may increase in viscosity ("thicken") upon exposure to one or more triggers or activators. The term activator may be considered synonymous with trigger and includes any device, mechanism, member, environmental condition, or combinations thereof for modifying a property of the flowable sealant. Non-limiting examples of suitable activators include magnetic, electromagnetic, light, acoustic, thermal, pressure, chemical, fluids, solids and combinations thereof. In another non-limiting embodiment the sealant may be or include a substance that may increase in volume ("expand") upon exposure to one or more triggers or activators. In yet another non-limiting embodiment the sealant 248 may be or include a substance that may increase in both viscosity and volume upon exposure to one or more triggers or activators.

The triggers that may activate the sealant 248 may include, but are not limited to, environmental conditions, a reactant or activator, a tool trigger, and/or a magnetic field. The environmental triggers or conditions may include, for example, temperature, pressure, the presence of oil, water, carbon dioxide, or other known or expected compounds that may be present in the borehole wall 204 and/or the formation 206. In another embodiment the environmental trigger may include a certain pH or a range of pH that may activate the sealant upon introduction to the area proximate the sample receiving port 209. The one or more tool triggers may include, for example, a heater or a cooler disposed in the pad 202, which when either heated or cooled activate the sealant. The one or more tool triggers can include an acoustic wave generated by an acoustic generator. The one or more tool triggers can include a light beam such as an ultraviolet light, infrared light, a laser, an incandescent light bulb, or other suitable light emitting device that when light is irradiated on the borehole wall 204 and/or into the formation 206 the sealant 248 may be activated. Another tool trigger can include one or more magnets, such as a permanent magnet, an electromagnet, or both.

The sealant 248 may be a flowable solid, liquid, or gas. In one embodiment a flowable solid sealant 248 may be in the form of a powder, flake, or granule, which may be suspended in a fluid to improve or facilitate introduction of the sealant into the region proximate the pad 202 and/or the sample receiving port 209. In another embodiment a flowable solid sealant, such as a powder, may be introduced to the region proximate the pad 202 and/or the sample receiving port 209 directly. In another non-limiting embodiment the sealant 248 may be or include a gel or other fluid that may thicken and/or expand due to a chemical reaction with one or more activating components introduced to the sealant 248. For a sealant 248 that may require an activator or activating component, the activator may be introduced to the sealant or the region within the borehole wall 204 and/or formation 206 proximate the pad 202 and/or the sample receiving port 209, before, simultaneously, and/or after the sealant is introduced into the region. In one non-limiting embodiment the sealant 248 may be or include a magnetically activated sealant, such as a magneto-viscous fluid. In another embodiment the sealant 248 may be or include a shear thickening sealant. A shear thickening sealant may be introduced to the borehole wall 204 through one or more nozzles and the viscosity of a shear thickening sealant may be increased as the sealant is sheared through the one or more nozzles. In another non-limiting embodiment the sealant 248 may include a shear thinning sealant. A shear thinning sealant may be introduced to the borehole wall 204 through one or more nozzles and the viscosity of a shear thinning sealant may be decreased as the sealant is sheared through the one or more nozzles. In another non-limiting embodiment the sealant 248 may be or include a pH sensitive fluid or solid. A pH sensitive sealant 248 may be chosen based upon the known and/or expected pH of the borehole wall 204 and/or the formation 206.

In several non-limiting embodiments the sealant 248 may be selected to withstand the environmental conditions, such as the temperatures, pressures, and other conditions in the borehole 110, borehole wall 204, and the formation 206. For example, the sealant 248 may be selected to withstand elevated temperatures ranging from about 50° C. to about 300° C. The sealant 248 may be selected to withstand a temperature of about 100° C. or more, about 150° C. or more, about 200° C. or more, or about 250° C. or more.

In at least one embodiment, in addition to introducing the sealant 248 proximate the sample receiving port 209, the sealant may cover or otherwise be introduced to an area directly in front of the sample receiving port, which may partially or completely seal off the sample receiving port 209 from the formation 206. Should the sealant 248 block or otherwise impede the sample receiving port 209 the sealant 248 may be removed by reducing the pressure within the sleeve 218 by using a pump 224. The fluid recovered via the sleeve 218 may be pumped through a dump line 234 until a pure formation fluid without or with a reduced amount of sealant 248 and/or other contaminants present is recovered.

In several embodiments the sealant 248 may be introduced to the region proximate the sample receiving port 209 prior to flowing fluid from the formation 206 to the sleeve 218. The sealant 248 may be introduced to the region proximate the sample receiving port 209 and allowed sufficient time to thicken and/or expand prior to removing fluid from the formation 206 to the sleeve 218. The sealant 248 may be used to reduce the permeability of the seal formed between the pad 202 and the borehole wall 204 within a suitable time. The sealant 248 may be used to reduce the permeability of the seal formed by the mud cake in the proximity of the pad 202 within a suitable amount of time. For example, the time for the sealant to reach a sufficient thickness, volume, or otherwise be modified to affect the formation system mobility may range from a few milliseconds to several hours. In at least one embodiment the time required for the sealant to modify the formation system mobility may range from a low of about 1 second, 5 seconds, or 10 seconds to a high of about 60 seconds, about 120 seconds, or about 180 seconds.

In one non-limiting embodiment the sealant 248 may be introduced to the region proximate the sample receiving port 209 at a pressure greater than the hydrostatic pressure of the formation fluid. For example, the sealant 248 may be introduced at a pressure of from about 100 kPa or more, about 300 kPa or more, about 600 kPa or more, about 800 kPa or more, or about 1,000 kPa or more above the hydrostatic pressure of the formation fluid. By increasing the pressure the sealant 248 is introduced into the area proximate the sample receiving port 209 the depth or distance the sealant can penetrate into the formation 206 may be increased.

In several non-limiting embodiments the sealant 248 may be introduced to the entire borehole wall 204 and/or the formation 206 within close proximity to the borehole 110, for example, the sealant may flow into the formation 206 for a controllable or uncontrollable distance or average distance of a few centimeters, a few meters, or several meters. In several non-limiting embodiments the sealant 248 may be introduced to selected sections or regions of the borehole 110, borehole wall 204 and/or the formation. For example a sealant 248 may be injected or otherwise introduced to a section or length of the borehole wall 204 and/or formation 206 of about 10 m, 20 m, 30 m, or more.

Referring in more detail to the sleeve 218, as used herein, the term "sleeve" means a member having a length, an outer cross-section perimeter and an inner cross-section perimeter creating a volume within the member. In the example of a cylindrical sleeve, the outer cross-section may be referred to as an outer diameter and the inner cross-section perimeter may be referred to as an inner diameter. The term sleeve, however, includes any useful cross-section shaped member that may not be circular as in the case of a cylinder, but may include other shapes including eccentric.

The sleeve 218 may be concentrically or non-concentrically disposed within the cavity 214. In the example of a concentrically disposed sleeve 218, an annular volume around the sleeve 218 may define the volume or portion of the cavity 214 that may be in fluid communication with the formation 206 adjacent the borehole wall 204 via the one or more the openings 208 disposed through the pad 202.

FIG. 3 shows an illustrative frontal view of a non-limiting extendable co-axial formation fluid sampling probe. Referring to the non-limiting examples of FIGS. 2 and 3, a concentrically disposed cylindrical sleeve 218 within the inner wall 216 of the probe 200 having a flow path 226 may have a concentric opening 208 in fluid communication with the cavity 214 disposed through the pad 202.

Continuing now with FIG. 2, the pump 224 in fluid communication with the flow line 228 may be used to reduce pressure within the sleeve 218. Reducing the pressure within the sleeve 218 may urge formation fluid into the sleeve 218. The pump 224 may be or include any system or device suitable for transferring or urging formation fluid into the flow path 226 within sleeve 218. For example, the pump 224 may be a circulation pump or a piston disposed within a chamber or cavity that may reduce pressure in the sleeve 218 by moving the piston. The flow line 228 may be used to convey fluid from the sleeve 218 to a fluid cell, which may include, but is not limited to, a sampling chamber 230, a test chamber 232, and/or a dump line 234 leading back to the borehole annulus. The dump line 234 may be coupled to the test chamber 232 as shown, or may be independent from the test chamber 232 not shown. In one non-limiting example, a fluid test and/or analysis device 240 may be used to determine the type and content of fluid flowing in the flow line 228. The fluid test device 240 may be located on either side of the pump 218, or as shown, on both the inlet and outlet of the pump 218 as desired.

Each of the pumps 224, 246 may be independently controlled by one or more surface controllers, or by one or more downhole controllers 236 as shown. The fluid flow in the probe 200 according to several embodiments may be controlled by controlling the flow rate in the flow path 226 via the pump 224. In operation, the pump 224 may be used during initial sampling to generate a flow rate in the flow path 226 that may remove sealant 248 and/or borehole fluid that may be present. The flow rate of the sealant 248 in the probe 200 according to several embodiments may be controlled by controlling the flow rate in the cavity 214 via the pump 246.

In the non-limiting example of FIG. 2, the probe 200 is shown mounted on the sub 106 (see FIG. 1). Although not shown, the probe 200 may be mounted on the downhole sub 106 at or near a centralizer, a backup shoe, and/or packers. A centralizer is a member, usually metal, extending radially from the downhole sub 106 to help keep the downhole sub 106 centered within the borehole. Other configurations of downhole tools may use ribs as centralizers or no centralizer at all as shown. In some cases, a back-up shoe may be used to provide a counter force to help keep a probe pad 202 pressed against the borehole wall 204.

The probe 200 may be coupled to the downhole sub 106 in a controllably extendable manner. In another example, the probe 200 may be mounted in a fixed position with an extendable rib or centralizer used to move the pad 202 toward the borehole wall 204.

Figure 4:
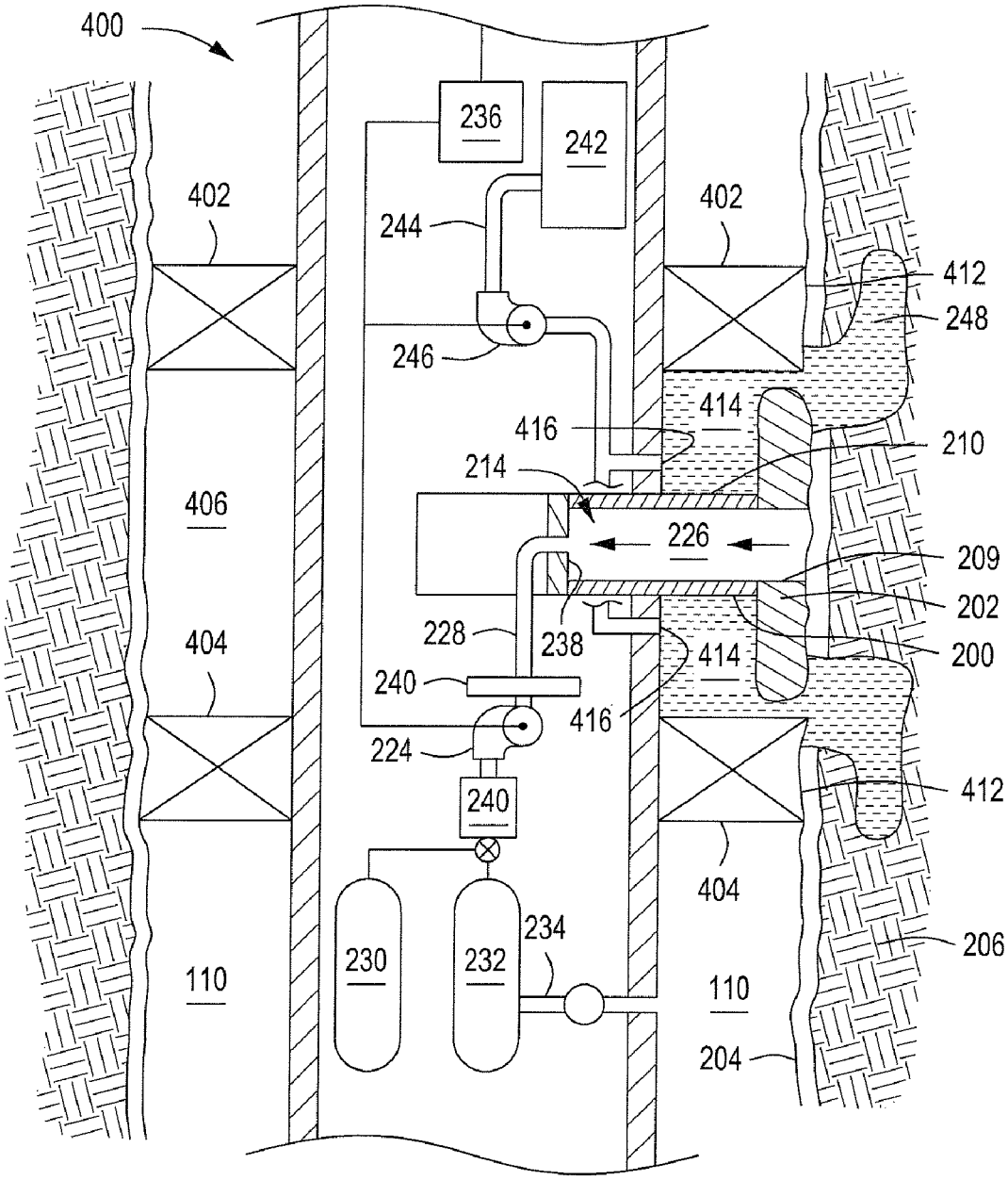
FIG. 4 is another elevation view that illustrates a non-limiting example of a downhole tool according to the disclosure.

FIG. 4 is an elevation view illustrating an exemplary formation sample tool 400 according to one or more embodiments. In several non-limiting embodiments the formation sample tool 400 may be used in an MWD arrangement, such as the downhole tool 124 described above and shown in FIG. 1. In one or more embodiments, exemplary formation sample tool 400 may be coupled to the formation evaluation tool 118, which may be part of the downhole sub 106 as described above and shown in FIG. 1. The formation sample tool 400 may be configured for use on any suitable carrier arrangement without departing from the scope of the disclosure.

The formation sample tool 400 may optionally include a pair of straddle packers that include an upper packer 402 and a lower packer 404. In several non-limiting embodiments, the packers 402, 404 may selectively expand to contact the borehole wall 204 to isolate an annular section 406 of the borehole 110 between the packers 402, 404. The packers 402, 404 may be actuated by any number of actuating mechanisms. The packers 402, 404 may be actuated using pressurized hydraulic fluid. In other embodiments, the packers may be mechanically compressed or actuated using hydraulically or mechanically actuated pistons or the like. When actuated, the packers 402, 404 seal an adjacent borehole wall area 406 between the upper packer 402 and the lower packer 404 to form a fluid barrier 412 across a portion of the borehole 110. In one example, the packers 402, 404 may include flexible bladders that deform sufficiently to maintain a sealing engagement with the formation even though the downhole sub 106 may not be centrally positioned in the borehole 110.

The formation sample tool 400 may be disposed between the upper packer 402 and the lower packer 404. The formation sample tool 400 may be substantially similar to the formation sample tool 124 described above and shown in FIGS. 1 and 2. The exemplary formation sample tool 400 shown may include a fluid sampling probe 200 having the durable rubber pad 202 at the distal end of the probe body 210. The pad 202 may include one or more openings or sample receiving ports 209 in fluid communication with a cavity or volume 214. The cavity 214 may be formed by an inner wall 216 of the probe body 210. The one or more sample receiving ports 209 may be disposed at the distal end of the probe body 210. The sample receiving port 209 may be in contact with or in close proximity to the formation 206 adjacent the borehole wall 204. The cavity 214 may provide fluid communication via a flow path 226 from the formation adjacent the borehole wall 204 to a flow line 228 in fluid communication with the rear section 238 of the probe body 210.

In several non-limiting embodiments the formation sample tool 400 may introduce a sealant 248 into the area proximate the pad 202 and/or the sample receiving port 209. In at least one non-limiting embodiment the sealant 248 may be as discussed above and shown in FIGS. 1 and 2. In several non-limiting embodiments the sealant 248 may be pumped by pump 246 from the sealant tank 242 or through a supply line from a sealant source, not shown in this view, into the borehole area 406 sealed by the upper packer 402 and the lower packer 404. The sealant 248 may flow into an area or volume 414 around at least a portion of the probe body 210. The sealant 248 may flow between the upper and lower packers 402, 404 and the pad 202 to provide an improved seal between the pad 202 and the borehole wall 204. The improved seal may provide a region proximate the sample receiving port 209 with a reduced permeability. In at least one embodiment a fluid may flow from the formation 206 through the sample receiving port 209 and into the cavity 214. The flow of the fluid may be reduced in amount or free of contaminants, such as borehole fluid, drilling fluids, and mud cake. In several embodiments a fluid sample recovered from the sampling probe 200 may be a high quality fluid sample from the formation 206.

In the non-limiting embodiment shown, the formation sample tool 400 may include the pump 224 in fluid communication with the flow line 228. The pump 224 may be used to reduce the pressure within the cavity 214. The flow line 228 may be used to convey fluid from the cavity 214 to the sampling chamber 230, the test chamber 232, and/or the dump 234 as discussed above and shown in FIGS. 1 and 2.

Figure 5:
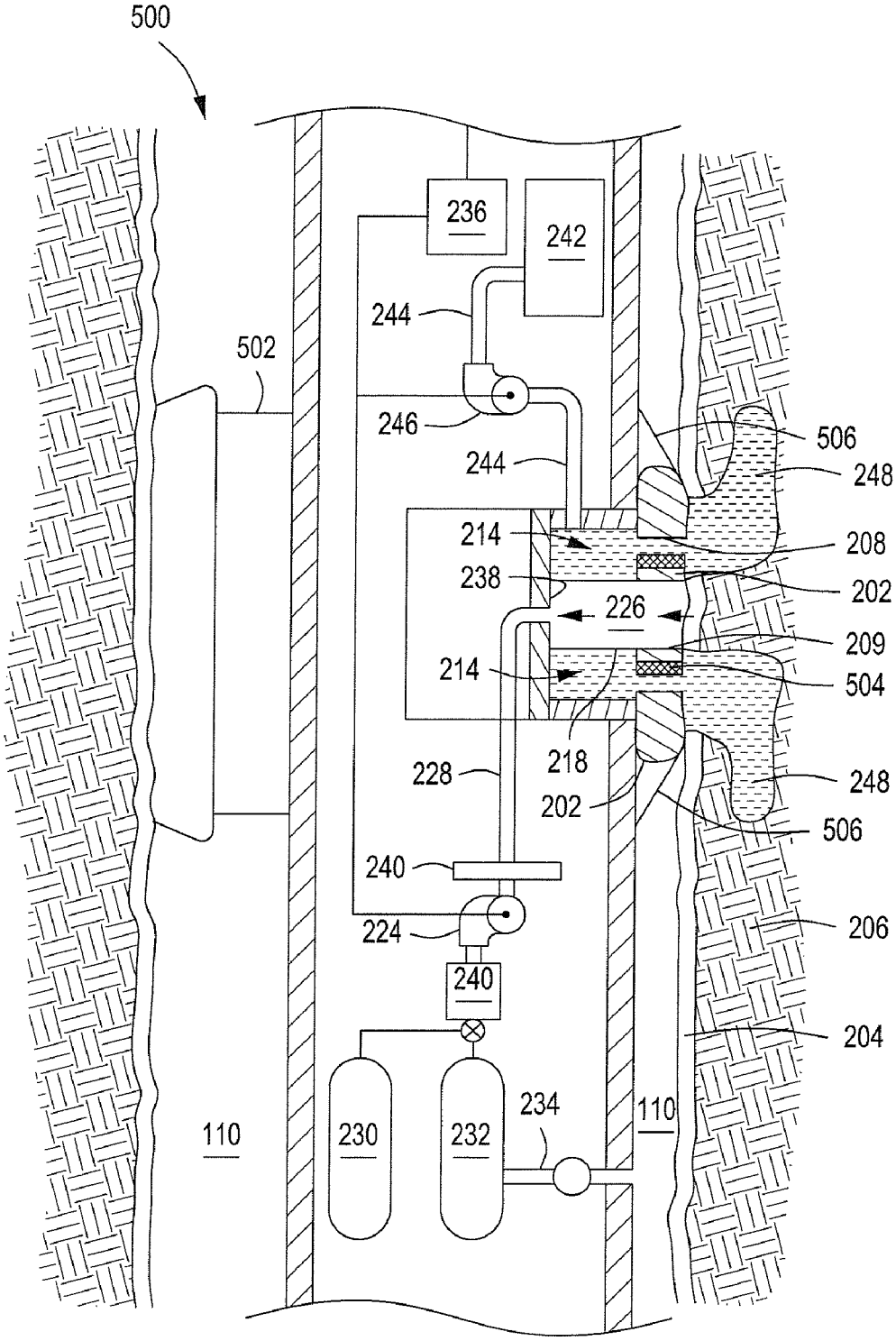
FIG. 5 is yet another elevation view that illustrates a non-limiting example of a downhole tool according to the disclosure.

FIG. 5 is an elevation view illustrating an exemplary formation sample tool 500 according to one or more embodiments. In several non-limiting embodiments the formation sample tool 500 may be used in an MWD arrangement, such as the downhole tool 124 described above and shown in FIG. 1. In one or more embodiments, exemplary formation sample tool 500 may be coupled to the formation evaluation tool 118, which may be part of the downhole sub 106 as described above and shown in FIG. 1. The formation sample tool 500 may be configured for use on any suitable carrier arrangement without departing from the scope of the disclosure.

The exemplary formation sample tool 500 may be substantially similar to the formation sample tools 124 and/or 400 as discussed above and shown in FIGS. 1-4. The sampling tool may have a durable rubber pad 202 as discussed above and shown in FIGS. 1-4. The pad 202 may be protected or guarded by a rigid member 506 that can protect the pad 202 while drilling and/or lowering the carrier into the borehole 110. The pad 202 may be opposed by one or more extendable pistons or feet 502. The pad 202 may be pressed against the borehole wall 204 by extending the one or more pistons 502. The extendable piston 502 may be hydraulically and/or electromechanically extendable to firmly engage the borehole wall 204. The extendable piston 502 may push or move the carrier the formation sample tool 500 is disposed on with enough force to engage the pad 202 with the borehole wall 204.

In several embodiments the formation sample tool 500 may include a magnet. The magnet 504 may be a permanent magnet or an electromagnet. In one non-limiting embodiment a suitable permanent magnet 504 may include a rare earth magnet, such as a neodymium iron boron or a samarium cobalt magnet; metal alloy magnets, such as an alloy of aluminum, nickel, and cobalt; ceramic magnets; or ferrite magnets. The magnet 504 may be any suitable shape, such as a bar, a ring, a doughnut, a disk, a rectangle, or other shape.

In one non-limiting embodiment the magnet 504 may be placed on, in, or about the pad 202 so as to be proximate the sample receiving port 209 of the formation sample tool 500. The magnet 504 may be disposed on, in, or about the sleeve 218, not shown, at the end adjacent the sample receiving port 209. The sample receiving port 209 may be in fluid communication with a sleeve 218 disposed within the cavity 214. The sealant 248 may be as discussed above and shown in FIGS. 2 and 4. In the exemplary embodiment shown with magnets 504 proximate the sample receiving port 209 the sealant may preferably be or include one or more magneto-viscous fluids. The magnetically activated sealant 248 may include a magnetic component. The magnetic component may be any paramagnetic component and/or any ferromagnetic component.

In the exemplary embodiment shown the sealant may be introduced from the sealant 242 to the cavity 214 via the flow line 244 and pump 246. The sealant 248 may flow through the cavity 214 and through the one or more openings 208 disposed through the pad 202 to an area proximate the sample receiving port 209. A fluid sample may be recovered from the formation 206 and introduced to a sample cell as discussed above and shown in FIGS. 1-4.

In several non-limiting embodiments the amount or concentration of the magnetic component in the sealant may be varied within a wide range, which may depend upon the desired viscosity increase. The magnetic component may be particulates. The size of the particulates may range from about 5 m to about 5 mm, or from about 1 μm to about 1 mm, or from about 5 μm to about 0.5 mm. For example, the size of the particulates may range from about 5 nm to about 5 μm. In order to influence the flow behavior of the sealant the magnetic particulates should be able to interact sufficiently with the surrounding fluid. The viscosity of the sealant 248 should be capable of increasing by a factor of about 3 or more, about 10 or more, about 30 or more, about 50 or more, or about 100 or more at a predetermined magnetic field intensity for a permanent magnet, or at a desired magnetic field intensity for an electromagnet. The magnetic particles may optionally be coated or encapsulated within a larger object. Coating or encapsulating the magnetic particles within a larger object may protect the magnetic particles against oxidation, corrosive compounds in the borehole 110 or formation 206, or other potentially damaging environmental conditions.

The magnet 504 may have any suitable magnetic field intensity. The magnetic field may have an intensity of about 0.01 Tesla to about 2 Tesla or more, or from about 0.5 Tesla to about 1 Tesla or more. The magnetic field may have an intensity of about 0.01 Tesla or more, about 0.05 Tesla, or more about 0.1 Tesla or more, about 0.5 Tesla or more. The sealant 248 may thicken upon introduction of the sealant to the area proximate the sample receiving port 209, which may be exposed to the magnetic field provided by the magnet 504. The magnetic field may have an intensity sufficient to cause the magnetic component of the sealant 248 to increase the viscosity of the sealant 248. The sealant may provide a seal with a lower permeability between the pad 202 and the borehole wall 204.

Figure 6:
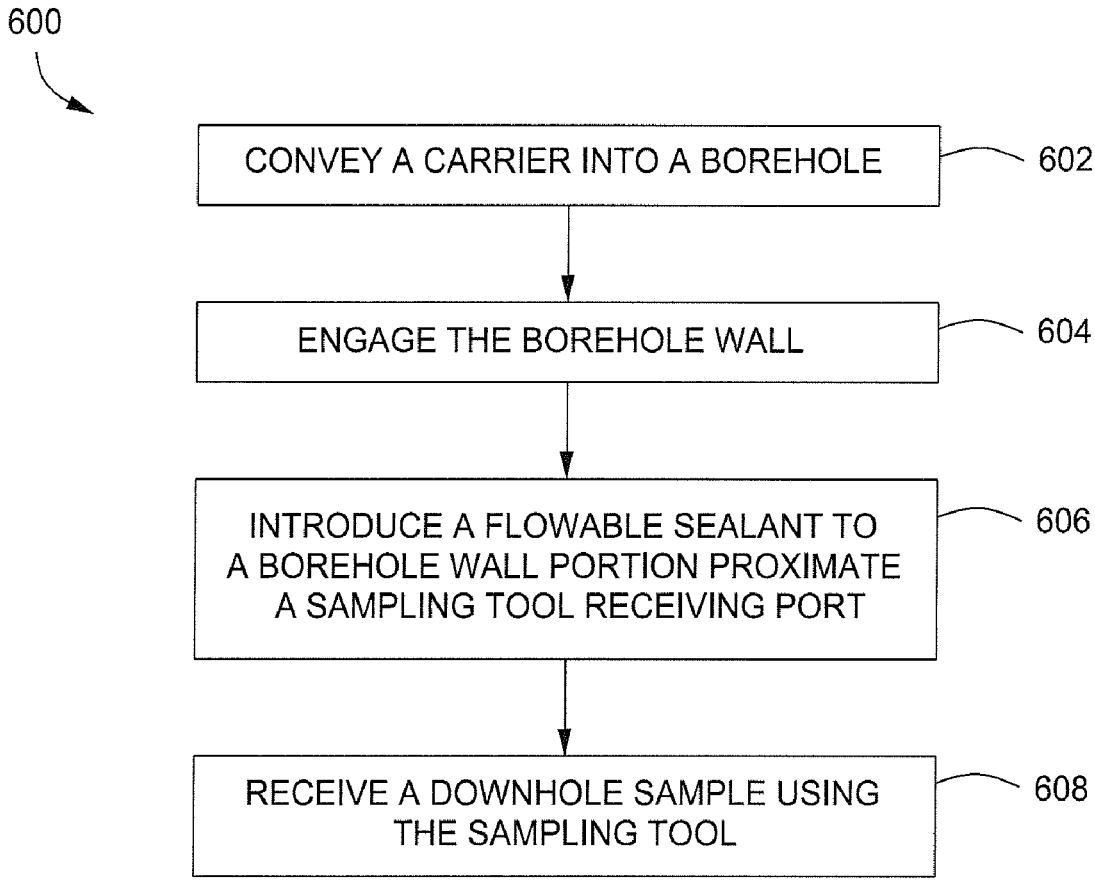
FIG. 6 illustrates a non-limiting example of a method for collecting a fluid from a subterranean formation.

FIG. 6 illustrates one example of a method 600 according to the disclosure. The method 600 includes conveying a carrier into a borehole 602. The carrier may include a formation sample tool coupled to the carrier. The formation sample tool may be substantially similar to the formation sample tools 124, 400, and 500 described above and shown in FIGS. 1-5. That is, the formation sample tool includes a sample receiving port for receiving a downhole sample. The formation sample tool includes a sealant device for introducing a sealant proximate the sample receiving port. The method 600 may further include engaging the borehole wall 604 with the formation sample tool to form a seal therewith. The method 600 includes introducing a sealant from the formation sample tool to a borehole wall portion proximate the sampling tool receiving port 606. The method 600 further includes receiving a downhole sample using the sampling tool 608.

Having described above the several aspects of the disclosure, one skilled in the art will appreciate several particular embodiments useful in determining a property of an earth subsurface structure using a downhole spectrometer.

In several embodiments, a method for collecting a downhole sample includes introducing a flowable sealant to a borehole wall portion, modifying a formation system mobility using the flowable sealant and receiving the downhole sample using the sample receiving port positioned proximate the borehole wall portion.

In a particular embodiment, the method for collecting a downhole sample includes introducing a magnetic field proximate the sample receiving port. In another embodiment the flowable sealant includes at least one of a shear thinning sealant, a shear thickening sealant, a pH activated sealant, a temperature activated sealant, a pressure activated sealant, an acoustically activated sealant, a light activated sealant, a chemically reactive sealant, and a magnetically activated sealant. In another embodiment the flowable sealant may be activated at least in part by at least one of one or more environmental triggers and one or more tool triggers.

In a particular embodiment, the flowable sealant includes a solid, a solid suspended in a fluid, or both. In another embodiment the flowable sealant may be introduced at a first viscosity, the flowable sealant changing to a second viscosity after introduction to the borehole wall portion. In another embodiment the first viscosity may be less than the second viscosity.

In one embodiment, the flowable sealant may be introduced at a first volume per gram of flowable sealant, the flowable sealant changing to a second volume after introduction to the borehole wall portion. In another embodiment the first volume per gram of flowable sealant may be less than the second volume. In at least one non-limiting embodiment the introducing the flowable sealant may include introducing the flowable sealant through the sample receiving port to the borehole wall portion proximate the sample receiving port.

In another particular embodiment, a method for collecting a downhole sample includes contacting a borehole wall portion using a sampling tool that includes a sample receiving port for receiving the downhole sample, the sample receiving port is in fluid communication with a fluid cell, introducing a flowable sealant to a borehole wall portion proximate the sample receiving port; and flowing the downhole sample through the sample receiving port to the fluid cell.

In another embodiment the method for collecting a downhole sample includes introducing a magnetic field proximate the sample receiving port prior to receiving the downhole sample. In one embodiment, the flowable sealant includes at least one of a shear thinning sealant, a shear thickening sealant, a pH activated sealant, a temperature activated sealant, a pressure activated sealant, an acoustically activated sealant, a light activated sealant, a chemically reactive sealant, and a magnetically activated sealant.

In another embodiment, the flowable sealant may be activated at least in part by at least one of one or more environmental triggers and one or more tool triggers. In another embodiment, the flowable sealant may be introduced at a first viscosity, the flowable sealant changing to a second viscosity after introduction to the borehole wall portion. In at least one embodiment, the first viscosity is less than the second viscosity.

In another embodiment, the flowable sealant may be introduced at a first volume per gram of flowable sealant, the flowable sealant changing to a second volume after introduction to the borehole wall portion. In at least one specific embodiment the first volume per gram of flowable sealant may be less than the second volume.

In several particular embodiments, an apparatus for collecting a downhole sample includes a formation sampling member having a sample receiving port for receiving the downhole sample and an inhibitor that includes one or more of an activator and an injector. In one embodiment, the apparatus includes at least one fluid moving device associated with the sample receiving port and the inhibitor.

In another embodiment the formation sampling member includes at least one of a permanent magnet and an electromagnet proximate the sample receiving port. In several particular embodiments, the flowable sealant includes at least one of a shear thinning sealant, a shear thickening sealant, a pH activated sealant, a temperature activated sealant, a pressure activated sealant, and a magnetically activated sealant.

In another embodiment, the flowable sealant may be introduced at a first viscosity, the flowable sealant changing to a second viscosity after introduction to the borehole wall portion. In at least one embodiment, the first viscosity is less than the second viscosity.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

Given the above disclosure of general concepts and specific embodiments, the scope of protection is defined by the claims appended hereto. The issued claims are not to be taken as limiting Applicant's right to claim disclosed, but not yet literally claimed subject matter by way of one or more further applications including those filed pursuant to the laws of the United States and/or international treaty.

What is claimed is:

1. A method for collecting a downhole sample comprising:

introducing a flowable sealant to a borehole wall portion through a sample receiving port;

modifying a formation system mobility using the flowable sealant; and receiving the downhole sample using the sample receiving port positioned proximate the borehole wall portion.

2. The method of claim 1, further comprising introducing a magnetic field proximate the sample receiving port.

3. The method of claim 1, wherein the flowable sealant comprises at least one of a shear thinning sealant, a shear thickening sealant, a pH activated sealant, a temperature activated sealant, a pressure activated sealant, an acoustically activated sealant, a light activated sealant, a chemically reactive sealant, and a magnetically activated sealant.

4. The method of claim 1, wherein the flowable sealant is activated at least in part by at least one of one or more environmental triggers and one or more tool triggers.

5. The method of claim 1, wherein the flowable sealant includes a flowable solid, a solid suspended in a fluid, or both.

6. The method of claim 1, wherein the flowable sealant is introduced at a first viscosity, the flowable sealant changing to a second viscosity after introduction to the borehole wall portion.

7. The method of claim 1, wherein introducing the flowable sealant includes introducing the flowable sealant to the borehole wall portion proximate the sample receiving port.

8. The method of claim 1, wherein the flowable sealant is introduced at a first volume per gram of flowable sealant, the flowable sealant changing to a second volume after introduction to the borehole wall portion.

9. The method of claim 8, wherein the first volume per gram of flowable sealant is less than the second volume.

10. A method for collecting a downhole sample comprising:

contacting a borehole wall portion using a sampling tool that includes a sample receiving port for receiving the downhole sample;

introducing a flowable sealant through the sample receiving port to a borehole wall portion proximate the sample receiving port; and receiving the downhole sample by flowing the downhole sample through the sample receiving port.

11. The method of claim 10, further comprising introducing a magnetic field proximate the sample receiving port prior to receiving the downhole sample.

12. The method of claim 10, wherein the flowable sealant comprises at least one of a shear thinning sealant, a shear thickening sealant, a pH activated sealant, a temperature activated sealant, a pressure activated sealant, an acoustically activated sealant, a light activated sealant, a chemically reactive sealant, and a magnetically activated sealant.

13. The method of claim 10, wherein the flowable sealant is activated at least in part by at least one of one or more environmental triggers and one or more tool triggers.

14. The method of claim 10, wherein the flowable sealant is introduced at a first viscosity, the flowable sealant changing to a second viscosity after introduction to the borehole wall portion.

15. The method of claim 10, wherein the flowable sealant is introduced at a first volume per gram of flowable sealant, the flowable sealant changing to a second volume after introduction to the borehole wall portion.

16. The method of claim 15, wherein the first volume per gram of flowable sealant is less than the second volume.

17. An apparatus for collecting a downhole sample comprising:

a formation sampling member having a sample receiving port for receiving the downhole sample; and an inhibitor configured to introduce a flowable sealant to a borehole wall portion, the inhibitor including the sample receiving port for flowing the flowable sealant therethrough and one or more of an activator and an injector.

18. The apparatus of claim 17, further comprising at least one fluid moving device associated with the sample receiving port and the inhibitor.

19. The apparatus of claim 17, wherein the activator includes at least one of a permanent magnet and an electromagnet proximate the sample receiving port.

20. The apparatus of claim 17, wherein the injector introduces a flowable sealant to a borehole wall portion, the flowable sealant comprising at least one of a shear thinning sealant, a shear thickening sealant, a pH activated sealant, a temperature activated sealant, a pressure activated sealant, an acoustically activated sealant, a light activated sealant, a chemically reactive sealant, and a magnetically activated sealant.

21. The apparatus of claim 20, wherein the flowable sealant is introduced at a first viscosity, the flowable sealant changing to a second viscosity after introduction to the borehole wall portion.

22. The apparatus of claim 17, wherein the flowable sealant is introduced at a first volume per gram of flowable sealant, the flowable sealant changing to a second volume after introduction to the borehole wall portion.

23. The apparatus of claim 22, wherein the first volume per gram of flowable sealant is less than the second volume.

* * * * *